US006021775A

United States Patent [19]

Dempsey et al.

[11] Patent Number: 6,021,775

[45] Date of Patent: Feb. 8, 2000

[54] MOBILE HOME FURNACE

[75] Inventors: Daniel J. Dempsey; Timothy J. Waterman, both of Carmel; Merle D. Sears, Mooresville; Scott A. Beck, Indianapolis; Larry D. Rieke, Zionsville, all of Ind.

[73] Assignee: Carrier Corporation, Farmington, Conn.

[21] Appl. No.: 09/164,683

[22] Filed: Oct. 1, 1998

[51] Int. Cl.[7] ..... F24H 3/06

[52] U.S. Cl. ..... 126/110 AA; 126/103; 126/116 R; 126/91 A

[58] Field of Search ..... 126/110 AA, 103, 126/116 R, 91 A

[56] References Cited

U.S. PATENT DOCUMENTS

| | | | |
|---|---|---|---|
| 3,685,577 | 8/1972 | Goodgion et al. . | |
| 4,467,780 | 8/1984 | Ripka | 126/91 A |
| 5,042,453 | 8/1991 | Shellenberger . | |
| 5,090,136 | 2/1992 | Hunt et al. . | |
| 5,309,890 | 5/1994 | Rieke et al. . | |
| 5,368,010 | 11/1994 | Weber, III et al. | 126/116 R |
| 5,375,586 | 12/1994 | Schumacher et al. . | |
| 5,408,986 | 4/1995 | Bigham . | |
| 5,437,263 | 8/1995 | Ellingham et al. | 126/110 AA |
| 5,443,364 | 8/1995 | Mistry et al. . | |
| 5,458,484 | 10/1995 | Ripka | 126/116 R |
| 5,562,089 | 10/1996 | Astle, Jr. | 126/116 R |
| 5,799,646 | 9/1998 | Zia et al. | 126/116 R |
| 5,878,740 | 3/1999 | Videto et al. | 126/91 A |

OTHER PUBLICATIONS

Sales Brochure BY–4349–003 for Bryant Horizontal Gas Furnace (1996).

Replacement Components Division Catalog No. BDP–3534–906 for Mid–Efficiency Horizontal Gas Furnace with Electric Ignition, 349HAZ by Ducane Corporation (1992).

*Primary Examiner*—Ira S. Lazarus
*Assistant Examiner*—Sara Clarke
*Attorney, Agent, or Firm*—Wall Marjama Bilinski & Burr

[57] ABSTRACT

A compact gas combustion furnace includes a substantially rectangular casing having an interior defined by a plurality of compartments. A draft inducer is mounted above the heat exchanger compartment to allow a multipass heat exchanger to be used while allowing the furnace to be fitted within a mobile home closet. A transition box couples the horizontally disposed inlet of the inducer and the vertically disposed outlet side of the heat exchangers. In a preferable arrangement, the furnace includes a burner assembly utilizing a plurality of burners, each having an arcuate shape in relation to a corresponding plurality of heat exchangers, and thereby occupying a minimum of space without loss of efficiency.

12 Claims, 6 Drawing Sheets

MOBILE HOME FURNACE

FIELD OF THE INVENTION

This invention relates to gas combustion furnaces. In particular, this invention relates to a compact down-flow gas furnace for use in a confined living space, such as a mobile home.

BACKGROUND OF THE INVENTION

In general terms, furnaces such as those commonly installed to heat homes operate by drawing air from the living area through the furnace, heating the air, and returning it to the living area. In some heating systems, the air drawn from the living area is also used for combustion before being vented to the outside. Other systems draw air for combustion from the outside. Duct systems are generally used to move the air, both heated and unheated, from one location to another. A blower forces the air drawn from the living area for heating through at least one heat exchanger. Usually, more than one heat exchanger is utilized. The heat exchangers are heated by combustion product gases generated by burners in a burner assembly aligned with the inlet to each heat exchanger. The burners receive fuel via a suitable fuel conduit, such as a manifold having orifices that direct the gas into the burners. The gas exiting the burners is ignited by an ignitor provided in a burner box. The burners allow combustion of the gas, as well as direct heated flue gas into the heat exchangers.

The typical heat exchanger includes cells with a channel or pass formed in each cell to direct the flow of flue gas produced by combustion and can be formed from sheet steel ("clamshell" exchangers) or steel tubing ("tubular" exchangers). These cells are typically positioned side by side in a parallel manner and include a predetermined spacing to allow the blower air to flow around the cells. The blower air is thus heated by convection as it circulates over the cells.

The flue gases are typically withdrawn from the heat exchanger by a draft inducer blower and ducted to the outside via a vent duct.

Mobile home furnaces are usually of the down-flow type, that is, the conditioned air ductwork is located below the space where the furnace is installed. Furthermore, known mobile home furnaces utilize drum-style heat exchangers, which are adequate for their purpose. However, it is preferred to utilize multipass clamshell type residential furnace heat exchangers. The size limitations of the mobile home closet, however, have not to date permitted the inclusion of these types of heat exchangers in a furnace design. Whereas a typical (residential) gas furnace for a standard home is approximately 28.5" deep, due to size constraints it is preferred that a mobile home gas furnace be typically 24" deep to fit within a specific closet. A multipass clamshell or tubular heat exchanger is typically about 18" deep, thus leaving 10" for a burner assembly in a typical residential gas furnace and only 6" for a burner assembly in a mobile home furnace. To date, and due to the above size constraints, a down-flow furnace design having clamshell or tubular heat exchangers, as described in the foregoing, has therefore not been available for use in a mobile home.

SUMMARY OF THE INVENTION

A primary object of the present invention is to improve the state of the art of mobile home gas furnaces.

Another primary object of the present invention is to provide a compact down-flow furnace using at least one multipass clamshell or tubular type heat exchanger, which can be readily installed without significant modification in a space confined environment, such as a mobile home closet.

Therefore and according to a preferred aspect of the invention, there is provided a compact gas furnace for use in a confined space, said furnace comprising:

- a substantially rectangular casing including an interior having a plurality of compartments;
- at least one heat exchanger disposed in a heat exchanger compartment, said at least one heat exchanger having an inlet side and an outlet side;
- a blower disposed in a blower compartment disposed above said heat exchanger compartment, said blower being in fluid communication with said at least one heat exchanger;
- a burner assembly including at least one gas burner aligned with the inlet side of said at least one heat exchanger; and
- a draft inducer comprising a housing disposed adjacent to the outlet side of said at least one heat exchanger, said inducer including inlet means for drawing combustion gases from said at least one heat exchanger and outlet means connected to vent means for venting said gases from said furnace, wherein said draft inducer housing is mounted above said heat exchanger compartment, said furnace further including means for coupling said draft inducer and said heat exchanger assembly, said coupling means including a transition box attached to said inlet means of said draft inducer for collecting combustion gases exiting said at least one heat exchanger.

According to a preferred embodiment, the burner assembly includes a plurality of arcuately shaped inshot burners, each burner being used in conjunction with a multipass clamshell or tubular heat exchanger and conveniently disposed to more efficiently maximize space savings.

Preferably, the draft inducer can be arranged above the heat exchangers, allowing larger heat exchangers to be used, by mounting the draft inducer horizontally and coupling the heat exchangers to a transition or coupling box mounted to the cell wall of the heat exchangers and in fluid communication with the inlet port of the inducer housing. Preferably, the furnace also includes a partition for separating the blower and venting compartments.

An advantage of the present invention is that a gas furnace utilizing a higher efficiency clamshell or tubular type heat exchanger usually found only in residential areas can now be configured for use in a tightly spaced environment, such as a mobile home.

Other objects, advantages, and features of the present invention will become apparent from the following Detailed Description of the Invention when read in conjunction with the accompanying drawings.

DETAILED DESCRIPTION OF THE INVENTION

The present invention is described herein relating to a preferred embodiment of a furnace in accordance with the present invention. Throughout the course of discussion, such terms as "front", "back", "side", "lateral", "top", "horizontal", "vertical" and "bottom" are used. These terms are meant to serve as a frame of reference for the accompanying drawings, and are not intended to be limiting with respect to the invention, except as indicated.

Figure 1:
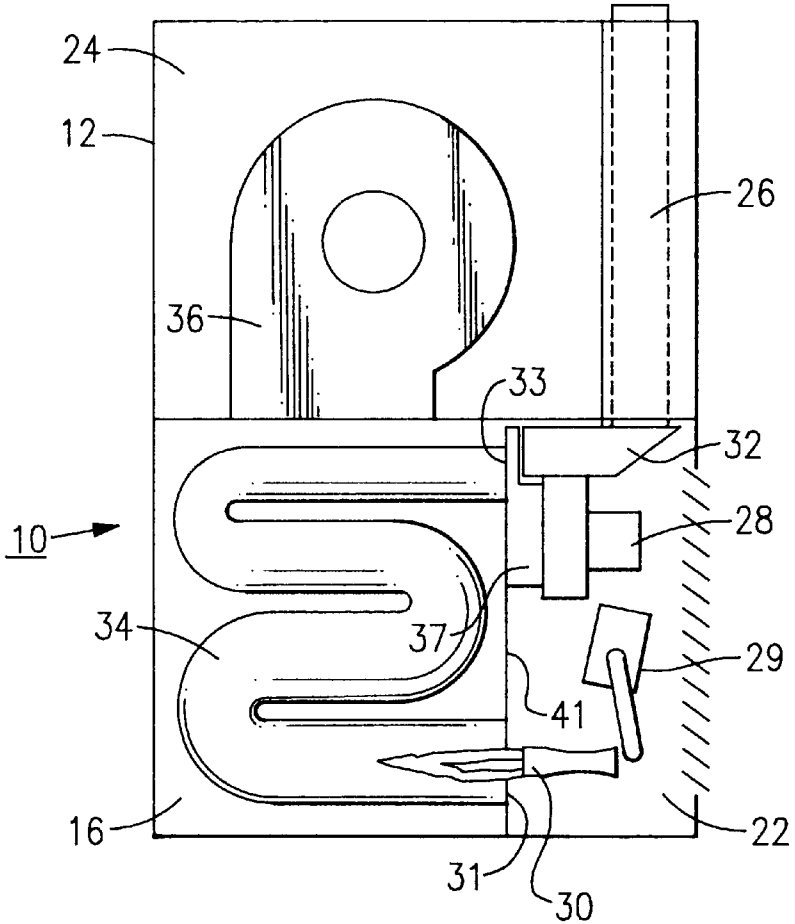
FIG.1 Prior Art
FIG. 1 is a side schematic partial view of a down-flow gas burning furnace in accordance with the prior art.
Figure 3:
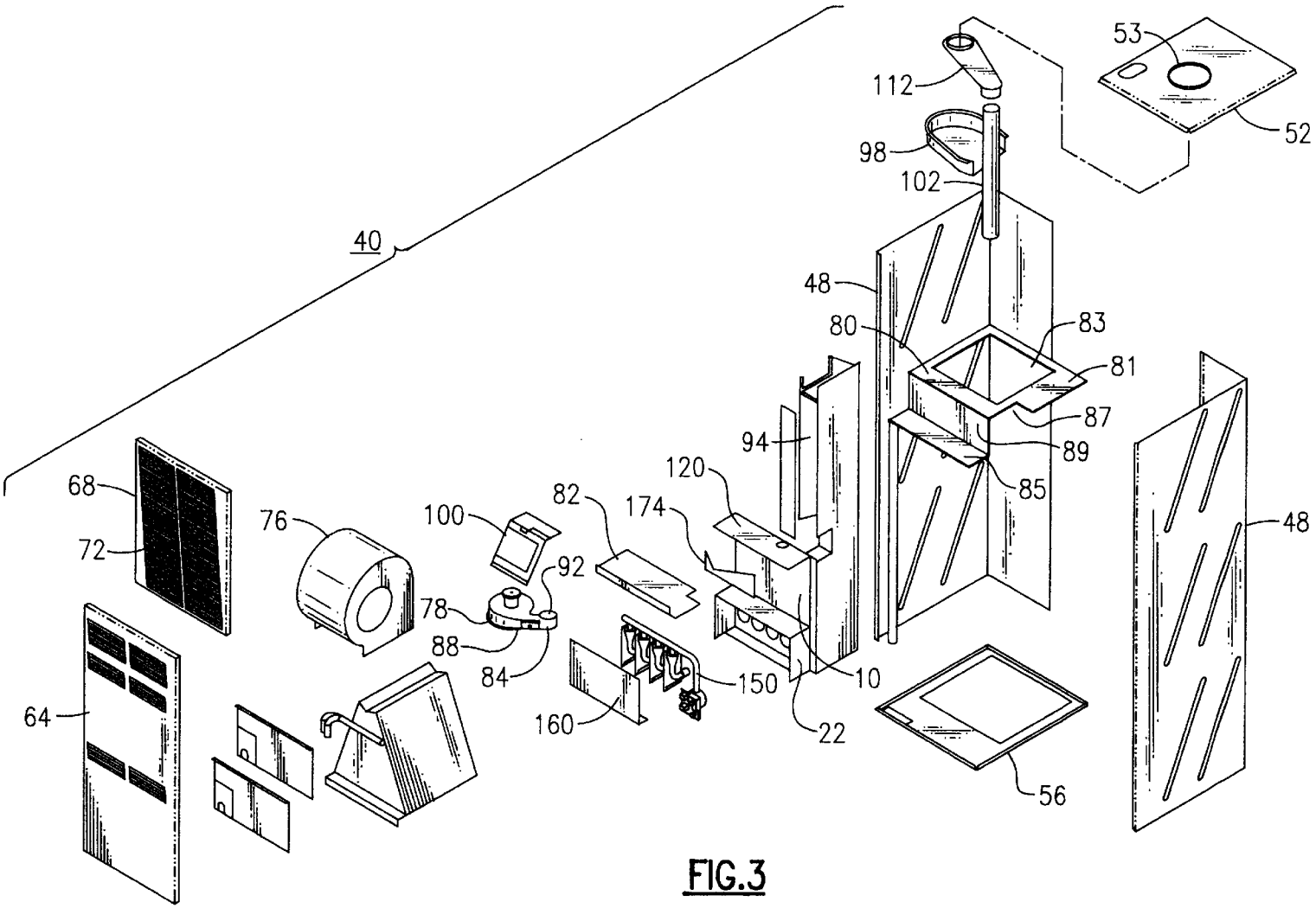
FIG. 3 is an exploded front isometric view of the gas burning down-flow furnace of FIG. 2.
Figure 4:
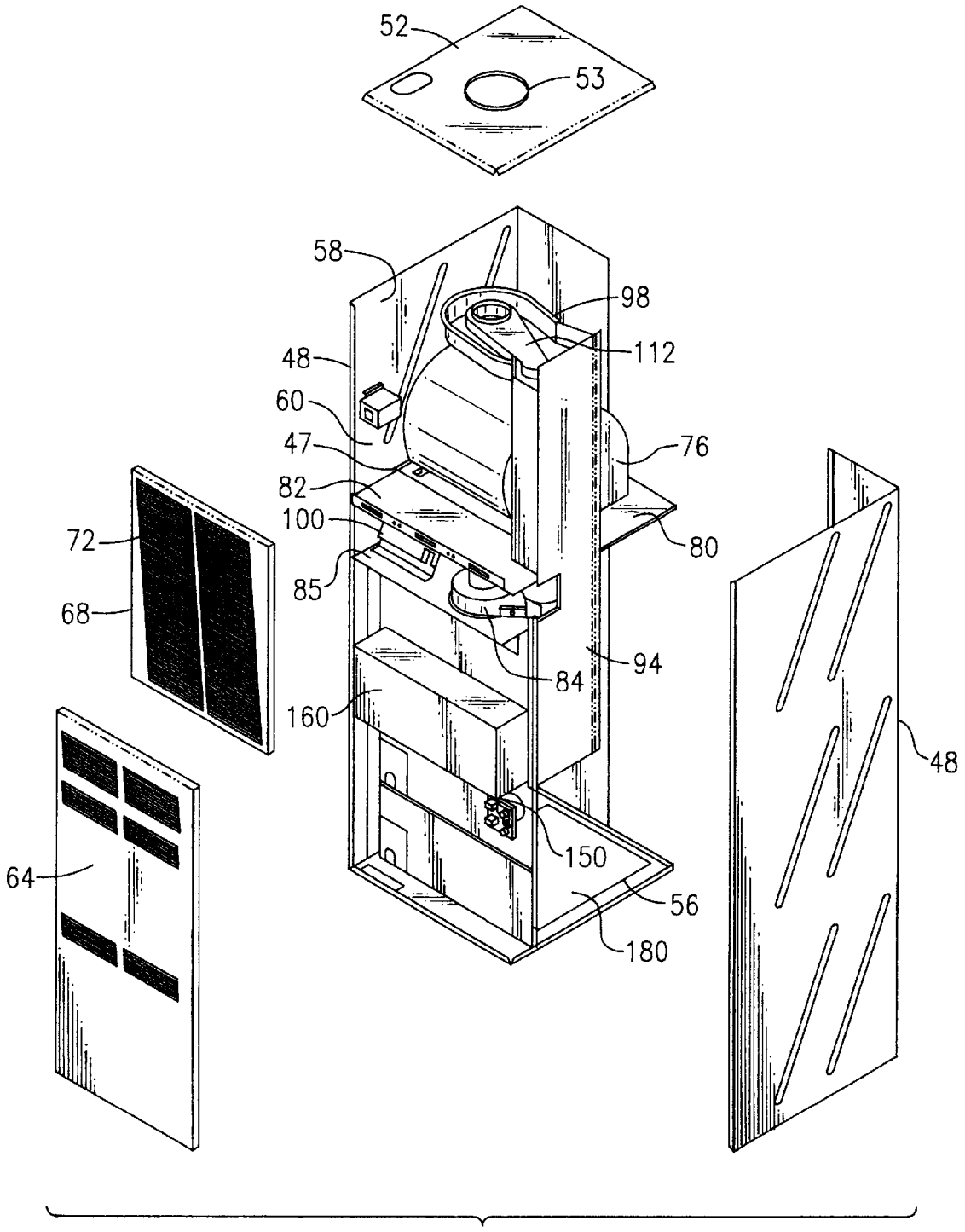
FIG. 4 is a front elevational view of the furnace of FIG. 2, in a partially assembled condition.
Figure 5:
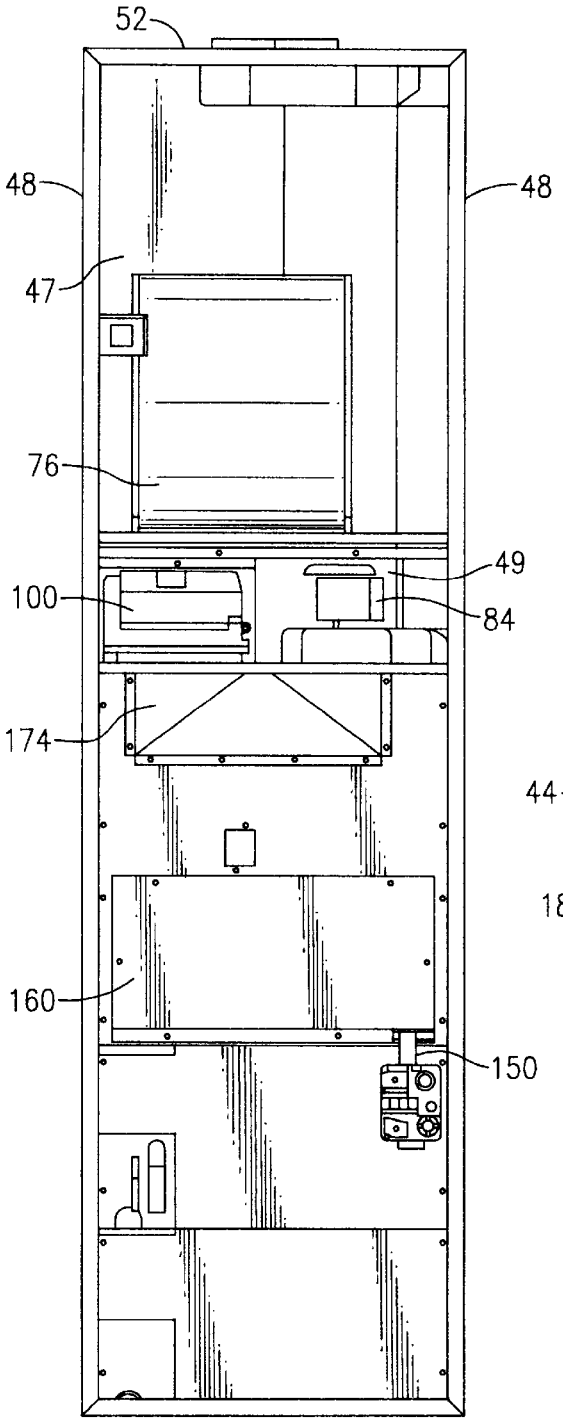
FIG. 5 is the front isometric view of the furnace of FIG. 2, in a partially assembled condition.

Referring to FIG. 1, and for background purposes, there is illustrated a down-flow furnace 10 in accordance with the prior art. Generally, the furnace 10 is defined by a rectangular casing 12 which encompasses substantially all of the components of the furnace. Moreover, the furnace 10 is divided into a number of interior compartments; specifically, a heat exchanger compartment 16 and a burner compartment 22, each of which are disposed beneath a blower compartment 24 containing an air circulating blower 36. As clearly shown in the Fig, the burner compartment 22 contains a burner assembly 29 disposed adjacent the heat exchanger compartment 16 which contains at least one multipass clamshell heat exchanger 34 (only one being shown), such as those manufactured by Carrier Corporation. It should be readily apparent that more than one heat exchanger can be positioned in parallel within the heat exchanger compartment 16. The heat exchanger 34 includes an inlet side 31 which accepts combustion gases from the burner assembly 29, the gases being drawn through the heat exchanger 34 by a draft inducer 28, located adjacent to the outlet side 33 thereof. When more than one heat exchanger 34 is used, a collector or transition box 37 couples the outlet side 33 of the heat exchangers 34 which gathers the flow, like a manifold, into the inlet side of the draft inducer 28.

The draft inducer 28 includes a motor (not shown) and a circular fan (not shown) included in a housing which is vertically mounted to the heat exchanger cell wall 41.

The combustion product gases pass through the heat exchangers 34 and give up heat by convection to the room air that is blown using the blower 36 over the heat exchangers 34. The combustion product gases exit the heat exchangers 34 via the draft inducer 28, which then directs the gases through ducting means, including a vertically disposed vent pipe 26, to the outside.

The burner assembly 29 includes a plurality of gas burners 30 (only one of which is depicted in FIG. 1), corresponding in number and aligned with the heat exchangers 34, which is ignited in a known manner to heat the combustion gases directed through the multipass clamshell heat exchanger 34. The burners 30 are typically of the straight inshot design, approximately 5 inches in length. The heated room air is directed by the circulating blower 36 downwardly to the vent work (not shown in this Fig.) located beneath the furnace 10. As noted above, the above described furnace 10 is acceptably used in residential areas but is generally too deep (approximately 28 inches) to fit within a mobile home closet, which is approximately 24 inches (approximately 61 cm) in depth.

With the following background, reference is now made to FIGS. 2–7, illustrating a similar type of gas furnace 40, but made in accordance with a preferred embodiment of the present invention. The furnace 40 includes a rectangularly shaped casing or housing 44, made from a pair of vertical casing sides 48, a casing top 52, and a complementary casing bottom 56, defining an interior 58 and an open front side 60. A louvered control door 64 covers a portion of the front side 60 of the casing 44 along with an intermediately disposed blower door 68 having a plurality of localized vents 72. A plurality of components, including an air circulating blower assembly 76, are contained in an upper half of the casing 44, defining a blower compartment 47. An evaporator coil compartment 180 is defined adjacent the casing bottom for maintaining an evaporator (not shown) for A/C purposes, if desired.

The blower assembly 76 is positioned onto an intermediately disposed blower shelf 80. The blower shelf 80 includes an upper planar and horizontally disposed shelf portion 81 having a large substantially center opening 83 sized for receiving the open side (not shown) of the blower assembly 76 for fluidly communicating with heat exchangers 116, as described below. The blower shelf 80 also includes a lower planar shelf portion 85 which mates up with the top of a horizontal cell panel 120 of the heat exchangers 116, the upper and lower planar sections 81, 85 being parallel to each other and separated by a vertical wall portion 89, each portion 81, 85 and 89 further defining a recessed or cutout portion 87, sized to allow the passage of a vertical intake air box 94, also as described below.

As opposed to the preceding design, the draft inducer assembly 84 according to the preferred embodiment is not vertically mounted to the cell wall of the heat exchanger, but is instead horizontally mounted on top of the lower planar shelf portion 85 of the blower shelf 80 and straddling cell panel 120. A filler plate 82 coplanar with the upper planar portion 81 separates the inducer assembly 84 from the blower compartment 47 and thereby forms a separate inducer compartment 49. According to the present embodiment, the inducer assembly 84 includes an assembly housing 88 having a discharge port 92 fluidly connected to a vent pipe 102 and an inlet port 78 for receiving the flue gases from the outlet side 118 of the clamshell heat exchangers 116. The assembly housing 88 includes a motor 128 mounted on one side thereof, one end of the motor shaft (not shown) being connected to a circular fan 140, FIG. 7, and in which a housing cover (not shown) is secured to the assembly housing 88 using conventional means.

The vertical vent pipe 102 interconnects the discharge port 92 of the draft inducer assembly 84 to a concentric vent box 112 having an outlet aligned with an opening 53 provided in the casing top 52. Concentric to the vent box 112 and also extending through the opening 53 in the casing top 52 is an intake air box 98. The intake air box 98 is interconnected to the burner box via the vertical intake air box 94 which extends along a substantial portion of the housing 44. The interconnection channels air for combustion to the burner compartment through an opening 179 provided in the cell wall 119.

Figure 2:
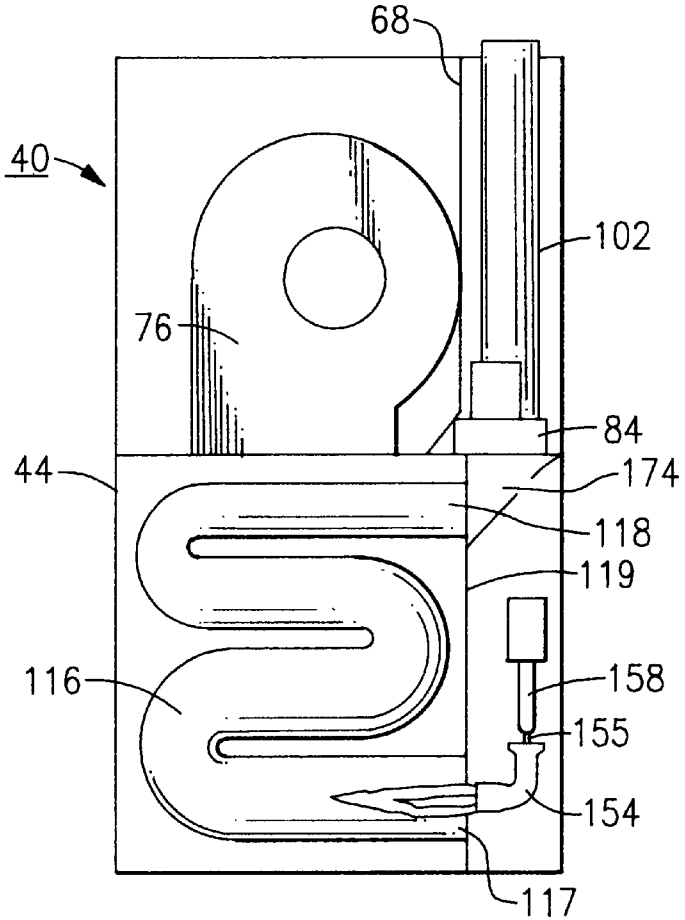
FIG. 2 is a side schematic partial view of a down-flow gas burning furnace in accordance with a preferred embodiment of the present invention.

The furnace 40, according to this embodiment, further includes a burner assembly 150 which receives fuel (e.g. combustion gas) from an inlet port (not shown). The fuel is passed through a series of orifices 155 (only one of which is shown in FIG. 2) used to control the pressure of the fuel. A series of horizontally arranged arcuate inshot burners 154 are contained in a mounting plate 156 which secures the burner assembly 150 to the cell wall 119. Here, each inshot burner 154 receives fuel from a manifold system 158, which is ignited and burned, delivering combustion gases to a corresponding series of heat exchangers 116. A gas control cover 160 is provided which is fitted over the front side of the burner assembly 150.

A control assembly 100 disposed adjacent the draft inducer assembly 84 in the defined inducer compartment 49 includes a number of control switches (not shown) for electrically interconnecting the pertinent mechanisms of the described furnace 40. Such control assemblies and systems, in and of themselves, do not form an essential part of the present invention, but are shown for the sake of completeness. Therefore, no further discussion pertaining thereto is required.

Figure 6:
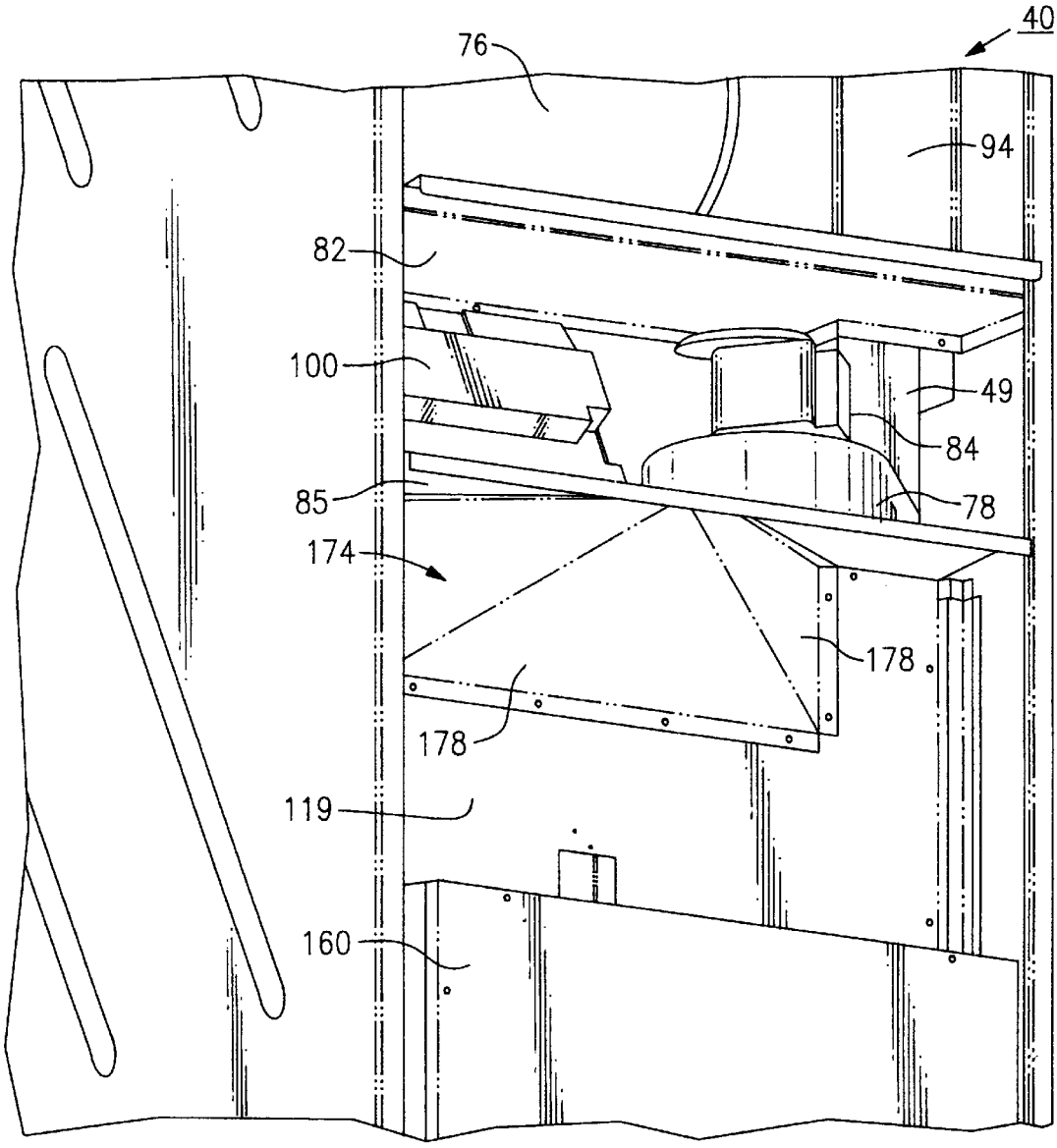
FIG. 6 is an enlarged partial side perspective view of the furnace of FIGS. 2–5.
Figure 7:
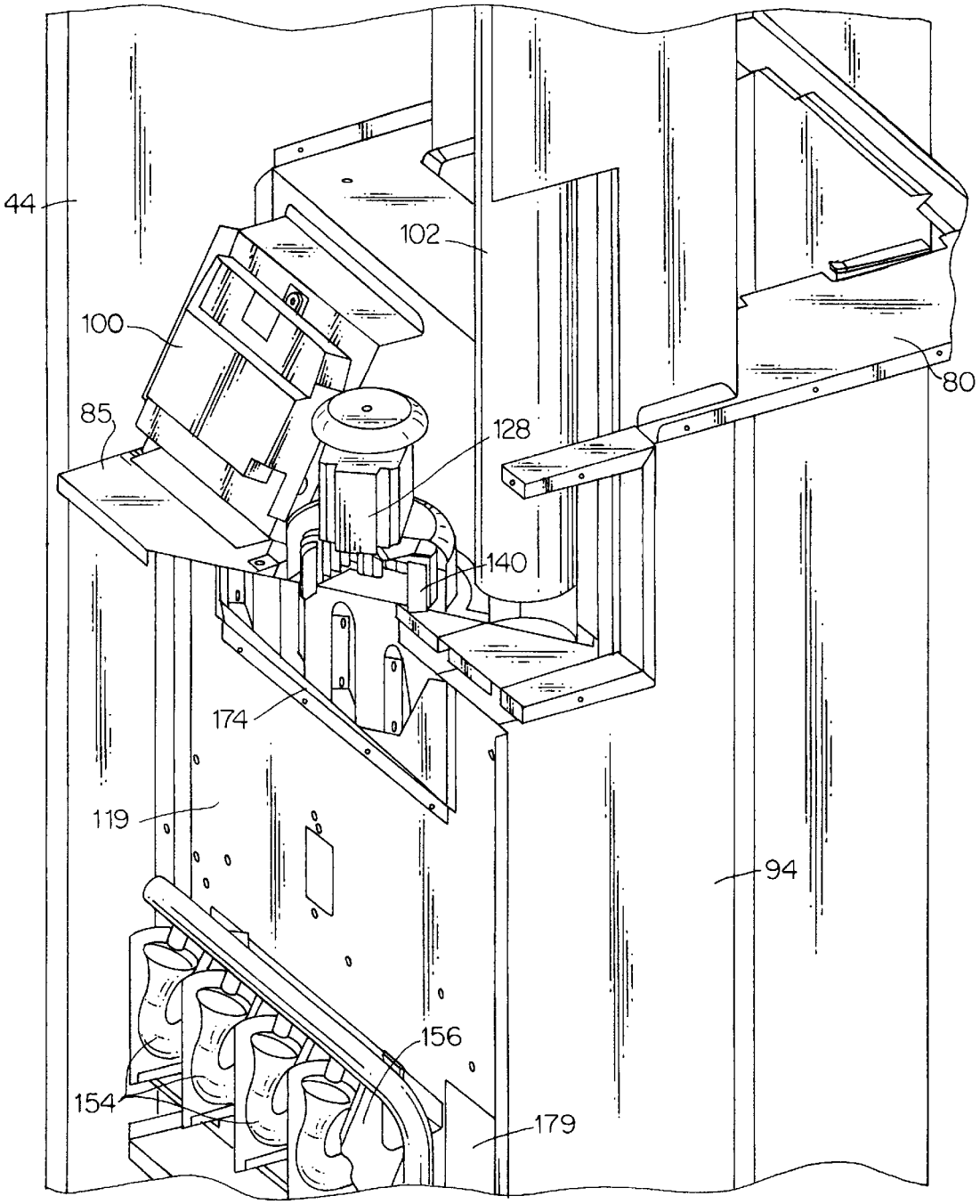
FIG. 7 is an enlarged partial front perspective view of the curved burner assembly of the furnace of FIGS. 2–6.

In order to properly conduct combustion gases from the heat exchangers 116 to the draft inducer assembly, a transition or collector box 174 is attached to the cell wall 119 of the heat exchangers 116 adjacent the outlet ports 118 thereof, as most particularly shown in FIG. 6. According to the present embodiment, the transition box 174 is conventionally secured and includes a plurality of inwardly angled surfaces 178, the surfaces preferably converging at a peak to form a triangular or pyramidal configuration. In this configuration, the transition box 174 serves to collect the combustion gases exiting from the heat exchangers 116 and to conduct them to the draft inducer assembly 84.

In use, room air is drawn into the interior of the heat exchanger compartment through the louvered doors of the casing 44 with the air passing over the heat exchangers 116. Each of the inshot burners 154 being aligned with the inlet side of a corresponding heat exchanger 116 heat the incoming blower air through ignition of the combustion gases. The flue gases are carried to the outlet side 118 of the heat exchangers 116 and collected into the transition box 174, allowing the combustion gases to be drawn to the inlet of the horizontally mounted draft inducer assembly 84, which then directs the combustion gases through the vertically disposed vent pipe 102 and outside the furnace 40. As stated above, the inclusion of the transition box 174, the horizontal positioning of the draft inducer assembly above the heat exchangers 116 and the use of the arcuate burners 154 each allow inclusion of the larger clamshell or other multipass heat exchangers 116, without sacrificing space requirements and therefore lend increased efficiency for furnaces which can be used, for example, in mobile homes.

Figure 8:
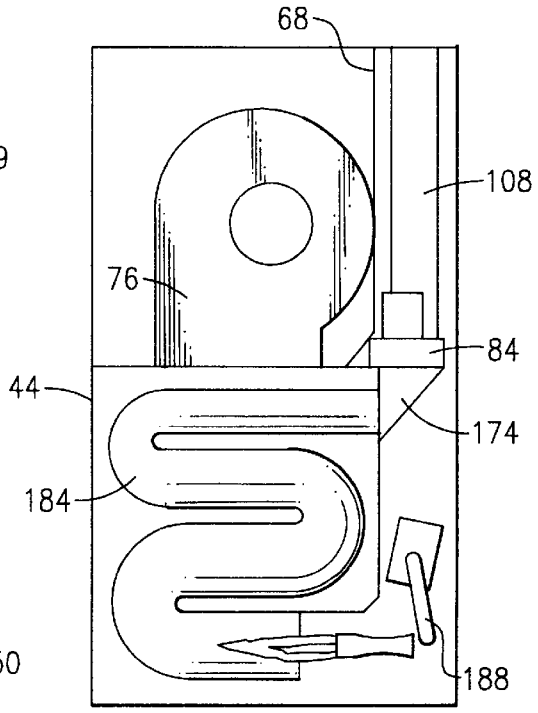
FIG. 8 is a partial side perspective view of a mobile home furnace in accordance with a second embodiment of the invention.

Alternately, and in lieu of the arcuate burners, a conventional burner assembly 188 similar to that shown in FIG. 1 can be utilized having the inlet pass of the heat exchanger 184 recessed inwardly, according to FIG. 8.

PARTS LIST FOR FIGS. 1–7

10 furnace
12 casing
16 heat exchanger compartment
22 burner compartment
24 blower compartment
26 vent pipe
28 draft inducer
29 burner assembly
30 burner
31 inlet side
32 duct means
33 outlet side
34 heat exchanger
36 blower
37 collector or transition box
40 furnace
41 cell wall
44 housing or casing
47 blower compartment
48 sides
49 inducer compartment
52 top
56 bottom
58 interior
60 open front side
64 control door
68 blower door
72 vents
76 blower assembly
80 shelf
81 top planar shelf portion
82 filler plate
83 opening
84 draft inducer assembly
85 lower planar shelf portion
87 cutout portion
88 housing
89 vertical wall portion
92 discharge port
94 vertical intake air box
98 upper intake air box
100 control assembly
102 vent pipe
112 concentric vent box
116 multipass heat exchanger
117 inlet side
118 outlet side
119 cell wall
120 cell panel
128 motor
140 fan
150 burner assembly
154 inshot burners
155 orifice
156 mounting plate
158 manifold system
160 gas control cover
174 transition or coupling box
178 angled surfaces
179 combustion air opening
180 evaporator coil compartment
184 heat exchanger
188 burner assembly While this invention has been described in detail with reference to a certain preferred embodiment, it should be appreciated to those of skill in the field that certain modifications and variations are possible which embody the concepts of the present invention as now recited in the following appended claims.

What is claimed is:

1. A compact gas furnace for use in a confined space, said furnace comprising:

a substantially rectangular casing including an interior having a plurality of compartments;

at least one heat exchanger disposed in a heat exchanger compartment, said at least one heat exchanger having an inlet side and an outlet side;

a blower disposed in a blower compartment disposed above said heat exchanger compartment, said blower being in fluid communication with said at least one heat exchanger;

a burner assembly including at least one gas burner aligned with the inlet side of said at least one heat exchanger; and a draft inducer comprising a housing disposed adjacent to the outlet side of said at least one heat exchanger, said inducer including an inlet for drawing combustion gases exiting from the outlet side of said at least one heat exchanger and an outlet which is connected to vent means for venting said combustion gases from said furnace, wherein said draft inducer housing is mounted above said heat exchanger compartment, said furnace further including means for coupling said draft inducer and said heat exchanger assembly, said coupling means including a transition box connected to the inlet of said draft inducer and allowing the inlet of said draft inducer to be arranged so as to be substantially orthogonal to the outlet side of said at least one heat exchanger.

2. The furnace as recited in claim 1, wherein said burner assembly includes a plurality of gas burners, each of said burners having a substantially arcuate shape.

3. The furnace as recited in claim 2, wherein said at least one heat exchanger is a multipass heat exchanger in which the outlet side and inlet side are disposed on a vertical cell wall.

4. The furnace as recited in claim 3, wherein said at least one multipass heat exchanger is a clamshell heat exchanger.

5. The furnace as recited in claim 3, wherein said at least one multipass heat exchanger is a tubular heat exchanger.

6. The furnace as recited in claim 3, wherein said draft inducer housing is orthogonally mounted relative to said vertical cell wall.

7. The furnace of claim 1, including a partition separating said blower compartment from the compartment containing said vent means.

8. The furnace of claim 1, wherein the outlet side of said at least one heat exchanger is disposed on a vertical cell wall and said draft inducer is mounted to a horizontal plate disposed above and adjacent to the outlet side of said at least one heat exchanger.

9. The furnace of claim 8, in which the inlet of said draft inducer is vertically disposed, said transition box being mounted to the vertical cell wall.

10. The furnace of claim 9, wherein said transition box has a substantially triangular configuration and includes an interior fluidly interconnecting the outlet side of said at least one heat exchanger and the inlet of said draft inducer.

11. The furnace of claim 1, including a horizontal plate disposed above said inducer assembly for separating said draft inducer from said blower compartment.

12. The furnace of claim 1, wherein a portion of the inlet side of said at least one heat exchanger is inwardly recessed relative to the outlet side thereof for allowing placement of said burner assembly.

* * * * *